United States Patent [19]

Plutt

[11] Patent Number: 4,898,389

[45] Date of Patent: Feb. 6, 1990

[54] IMPACT INDICATING GOLF TRAINING DEVICE

[76] Inventor: Daniel J. Plutt, 3543 Smuggler Way, Boulder, Colo. 80303

[21] Appl. No.: 93,994

[22] Filed: Sep. 8, 1987

[51] Int. Cl.[4] ..... A63B 69/36

[52] U.S. Cl. ..... 273/186 A; 273/194 A

[58] Field of Search ..... 273/186 A, 186 D, 266, 273/194 A, 183 D

[56] References Cited

U.S. PATENT DOCUMENTS

| | | | |
|---|---|---|---|
| 3,323,367 | 6/1967 | Searle | 273/183 D |
| 3,438,634 | 4/1969 | Roy | 273/186 A |
| 3,730,529 | 5/1973 | Donofrio | 273/186 A |
| 3,992,013 | 11/1976 | Golden | 273/194 R |
| 4,088,324 | 5/1978 | Farmer | 273/186 A |
| 4,094,504 | 6/1978 | Barasch | 273/186 A |

FOREIGN PATENT DOCUMENTS

| | | | |
|---|---|---|---|
| 536 | 1/1977 | Japan | 273/186 A |
| 8000217 | 2/1980 | PCT Int'l Appl. | 273/186 A |
| 2066676 | 7/1981 | United Kingdom | 273/186 A |

*Primary Examiner*—Leonard E. Smith
*Assistant Examiner*—D. Scheuermann
*Attorney, Agent, or Firm*—Donald W. Margolis

[57] ABSTRACT

A self contained gold training device designed to be integral with, or attached to and detached from the head of any golf club, gives a golfer an exact indication of the point of impact of the face of a golf club with a golf ball. The training device includes a housing which supports one or more impact sensitive transducers which generates an electric signal upon impact, an electronic circuit for determining if a transducer has received an impact, a display system responsive to the electronic circuit for signaling if a transducer has received an impact, a source of electrical power; and, in detachable systems, means for connecting and disconnecting the device to a golf club head. When attached to the head of a club, with the array of transducers on the face of the club, and swung into contact with a golf ball, the transducers generate a plurality of electrical signals which are transmitted to the electronic processor, and then to the display system which indicates the point of contact of the club face with the ball. In preferred embodiments there is an array of transducers, which, when they strike a golf ball, each generates a voltage which is proportional to the force exerted on that transducer by its impact with the ball. These voltages are in turn analyzed by an electronic circuit which then causes the display system to indicate the point of impact.

12 Claims, 3 Drawing Sheets

IMPACT INDICATING GOLF TRAINING DEVICE

BACKGROUND OF INVENTION a. Field of the Invention

The present invention relates to an amusement device for use in golf practice. More specifically it relates to such a device having an indicator which is responsive to the impact of the face portion of a club head with a golf ball.

b. Discussion of the Prior Art

In the game of golf, developing a consistent, repeatable stroke which allows a golfer to consistently strike the ball with the impact center, or "sweet spot" of the golf club face is necessary to maintaining and to improving the players game. This is due to the fact that when a ball is struck with the sweet spot of the golf club face the maximum energy is transferred to the ball, and does not impart any side spin to the ball which would cause it to drift off of a controlled line to the target. Due to the speed at which the club is moving at the time that it impacts with the ball, even in the putting stroke, it is generally impossible for a player to tell exactly which part of the golf club face has struck the ball. Knowledge of the point of contact of the golf club face during the putting stroke is particularly important since any slight error in hitting the golf ball with the impact center of the golf club face will dramatically cause the ball to spin, and thus drift off of the line along which it is directed, or fail to impart the desired energy to the ball so that it stops short of the hole. Since accuracy in both distance and direction are most critical in the putting stroke, even a small degree of miss in the putt has a substantial effect on the direction and distance that the ball travels. Therefore, the fact that a golfer cannot tell the exact point of impact of the club face of the putter with the ball is particularly frustrating. Even an instructor watching a golfer strike the ball with a club cannot always tell exactly which part of the club face is striking the ball, and thus may be only able to make general suggestions to the player as how to improve his or her stroke.

Prior to the present invention, any changes made to the putting stroke could only be judged as to their effectiveness by playing with the changes for a period of time. This has rarely been conclusive as to the effectiveness or consistency of the change, since other factors, such as alignment, condition of the putting greens, and the day to day changes in a players concentration may have as much effect on the accuracy of the putt, as the attempted change.

In the prior art, U.S. Pat. No. 3,438,634 provides a system which depicted the effectiveness of a golfers swing. This is accomplished by providing a plurality of conductive plates arranged in a segmented pattern on the face of a special golf club. Each plate is connected by an electrical cable through the golf club shaft to an external console on which a pictorial representation of the club face is depicted. As a part of the console, a lamp is associated with each segment of the club face representation which corresponds to a plate on the face of the player's club. A special, non-playable target ball is mounted on a flexible arm, and a contact element on the target ball is also electrically connected to the display console by means of a conductor embedded in the flexible mounting arm. When the special golf club is swung into engagement with the contact element of the special target ball a circuit is completed which illuminates one or more of the lamps on the external console, which lamps correspond with the one or more plate segment on the face of the player's club which made engagement with the special ball. Thus, by studying the lights displayed on the external console, the player can see and record the point of impact of the club face with the target ball, and thus, the effectiveness of his swing. However, since the device is not self contained, and is effectively tethered in place, it can only be used in practice, and not in actual playing situations.

Also of interest is U.S. Pat. No. 3,730,529, which discloses a self contained stroke indicating golf club which operates mechanically to visually indicate the area of contact of the club face with the golf ball. This is accomplished by providing a plurality of physically displaceable and repositionable pins which extend fore and aft through the club head. The club is depicted as being usable for normal golf. It will of course be appreciated that the weight and balance of such a club will not have the same balance and feel as a normal club, and that the line of contact between the displaceable pins and the ball will be inherently different from the plane of contact which is provided by a normal club face. Also, in order to obtain the benefit of this patented system for the play of each club, each club must be separately modified or replaced, since the device cannot be transferred from club to club.

Other prior art of interest includes U.S. Pat. No. 4,094,504, which discloses a signaling device which is adapted to be associated with a sport implement, such as a golf club, to indicate proper alignment of the implement, with the stroke direction; and U.S. Pat. No. 4,138,118 which discloses a golf club training device which includes pressure sensitive transducers in the handle to indicate the correctness of a players grip. This latter device also includes a single transducer in the face of the club which indicates the moment of impact between the club and the ball. Neither of these latter references has any utility for indicating the point of impact of the face of a club with a golf ball.

SUMMARY OF THE INVENTION

It is therefore an object of the present invention to provide a self-contained device which generates an electric signal to indicate the point of impact between the face of a golf club and a golf ball, thereby allowing an individual golfer to practice his stroke repetitively and obtain a direct readout from a monitor associated with the club to ascertain if the ball is being hit directly at the sweet spot, or to otherwise indicate the contact area of the face of the club head with the ball.

It is another object of the present invention to provide such a device in a self-contained package which allows it to be integrated with the head of any golf club.

It is another object of the present invention to provide such a device which is self-contained, and thus allows it to be attached to and detached from any golf club.

It is another object of the present invention to provide such a self contained device for indicating the area of impact of the face of the head of a golf club with a ball which includes one or more impact sensitive transducer element which generates an electrical signal when it receives an impact; means for locating said one or more impact sensitive transducer element to the head of a golf club so that said one or more impact sensitive element overlies the face of the club in some predefermined relationship to the impact center of the face of the club; and means responsive to an electrical signal generated by said one or more transducer element, whereby, when the face of the head of a golf club impacts with a golf ball, an electrical signal is generated to cause said electric signal responsive means to signal the area of impact of the face of the club with a ball.

It is yet another object of the present invention to provide such a device which includes means for connecting and disconnecting the device to a golf club head.

It is yet another object of the present invention to provide such a device which is in no way tethered in place, and which therefore can be used in actual practice and playing situations.

It is yet another object of the present invention to provide such a device which does not substantially affect the balance, feel or operation of the club to which it is attached.

It is yet another object of the present invention to provide such a device which allows a full plane of contact between the club face and the ball.

It is still yet another object of the present invention to provide such a device which may be easily attached to or integrated with substantially any club, and, which in some form, is capable of being transferred from club to club.

The general object of the present invention is to provide a self contained apparatus for use by a golfer in practicing his swing, said apparatus providing an immediate electrical indication of the precise point of impact between the face of a golf club and any ball.

In order to achieve these objects, the present invention provides a self contained battery powered device for indicating the area of impact of the face of a golf club with a golf ball. The self contained golf training device is designed to be either integral with, or attachable to and detachable from the head of any golf club. Whether integral with the club or detachable, the device of the present invention immediately provides a golfer with a precise indication of the point of impact of the face of the golf club with a golf ball. Furthermore, the device is designed to be so small and so light weight, and the transducers so thin, that it will allow a golfer to use it during regular playing situations, as well as during practice.

The training device of the present invention includes a housing which supports an array of one or more thin film impact sensitive transducers designed to be mounted on the face of a golf club, an electronic circuit, a source of electrical power, a monitor for instantly indicating the point of contact between the club face and a ball; and, in detachable systems, means for connecting and disconnecting the device to and from a golf club head. When the device is attached to the head of a club, with one or more thin film transducers on the face of the club, and the club swung into contact with a golf ball, the one or more transducer generates one or more electrical signal which is transmitted to the electronic circuit. The electronic circuit analyses the one or more signal to determine the point of contact, and then transmits the results of its analysis to the monitor. The monitor then visually or audibly indicates the point of contact of the club face with the ball. In preferred embodiments, when the array of transducers on the face of the club head strikes a golf ball, each one or more transducer will generate a voltage which is proportional to the force exerted on that transducer by its impact with the ball. These voltages are then in turn analyzed by the electronic circuit which determines the area of impact, and then relays that information to the monitor for display.

In preferred embodiments the monitor will provide the golfer with a visual display, such as an array of liquid crystal displays (LCDs) or light emitting diodes (LEDs). The visual display may be located on the top surface of the club head or attached to the shaft in a position which is visible to the golfer as he or she holds the club handle in a normal grip and looks down the shaft of the club. In some instances an audible signal, for example, one which varies in pitch according to the point of impact can be used to indicate the degree of correctness of the impact. The visual or audible display can be designed to last for a predetermined period of time, after which it will terminate and the system will reset itself to receive and analyze another impact. The self contained nature of the device allows it to be either integral with, or designed for attachment to or removal from any club.

It is therefore seen that the present invention gives the golfer instant feedback on the exact point at which the club face strikes the ball. This allows the golfer to practice on his own and to quickly make changes to his or her swing to determine if such changes improve his or her ability to consistently strike the ball with the impact center of the club face. Where the intent of the practice is to determine or to correct which portion of the club face is impacting the ball, then, in many instances, the device of the present invention eliminates the need to have an instructor watching while the golfer practices. It also eliminates the consideration of many other factors in the putting stroke, such as alignment and the difficulty of the putting surface, thus allowing the golfer to concentrate solely on improving the mechanics and reproducibility of his or her stroke. Once these impact mechanics are perfected, the golfer can then work on his or her ability to read putting greens and on alignment, all while the device is attached since it has substantially no effect on how the golf club performs. It also allows the golfer to practice on any surface since, when using the device he or she is only attempting to improve the reproducibility of his or her stroke as determined by the point of impact of the club face with the ball.

For additional objects and advantages, as well as for a fuller understanding of the nature and objects of the present invention, reference should be made to the following detailed description taken in conjunction with the accompanying drawings.

BRIEF DESCRIPTION OF THE DRAWINGS

The accompanying drawings illustrate complete preferred embodiments of the present invention according to the best modes presently conceived for the practical application of the principles thereof, and in which.

DETAILED DESCRIPTION OF THE INVENTION

Figure 1:
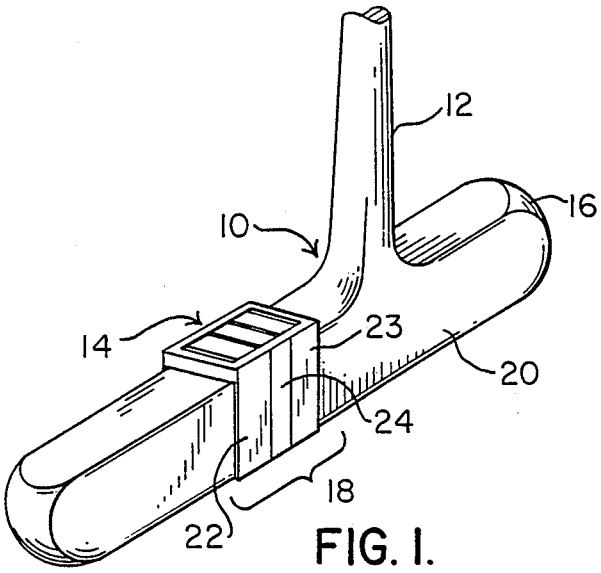
FIG. 1 is a fragmentary isometric view of a golf club, in this embodiment a putter, on which is attachably and detachably mounted one embodiment of the device of the present invention in which there are three transducer elements.
Figure 3:
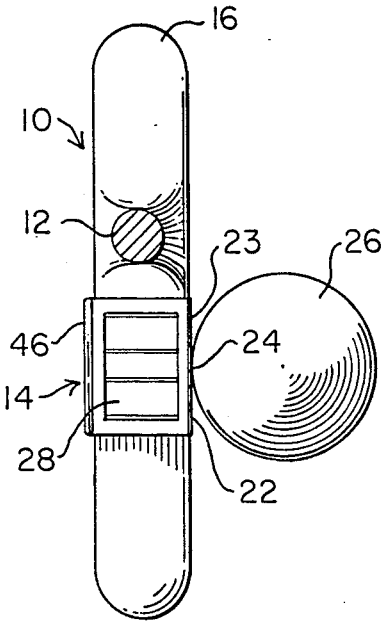
FIG. 3 is a top plan view of the system of FIG. 1, showing a putter with the center transducer of the device of the present invention striking a golf ball.

Referring now to FIG. 1 of the drawings, there is disclosed a golf club 10, in this embodiment a putter, having a shaft 12 fragmently shown. Self contained impact indicating device 14 of the present invention is attached and positioned to club head 16 so as to have thin film transducer array 18 located on face 20 of club head 16. As shown, thin film transducer array 18 includes three transducers, namely a pair of outer transducers 22 and 23, and a middle transducer 24. As represented in FIG. 1, middle transducer 23 is positioned over the impact center, or sweet spot, of face 20 on club head 16. Transducer array 18 is attached to the face of club head 16, for example, by its own natural adhesion, by gravity, or by double sided tape (not shown). In any event, transducer array 18 is designed and constructed to be sufficiently thin, smooth, and planar so as to have substantially no effect on the planar performance of face 20, or on the weight and feel of club 10 when it impacts a golf ball 26, as shown in FIG. 3. The transducers of array 18 may be formed from any impact sensitive thin film transducer element which generates an electric signal on impact, such as, for example, piezo-electric material, capacitor material, force sensitive resistance polymer, or others.

Figure 2:
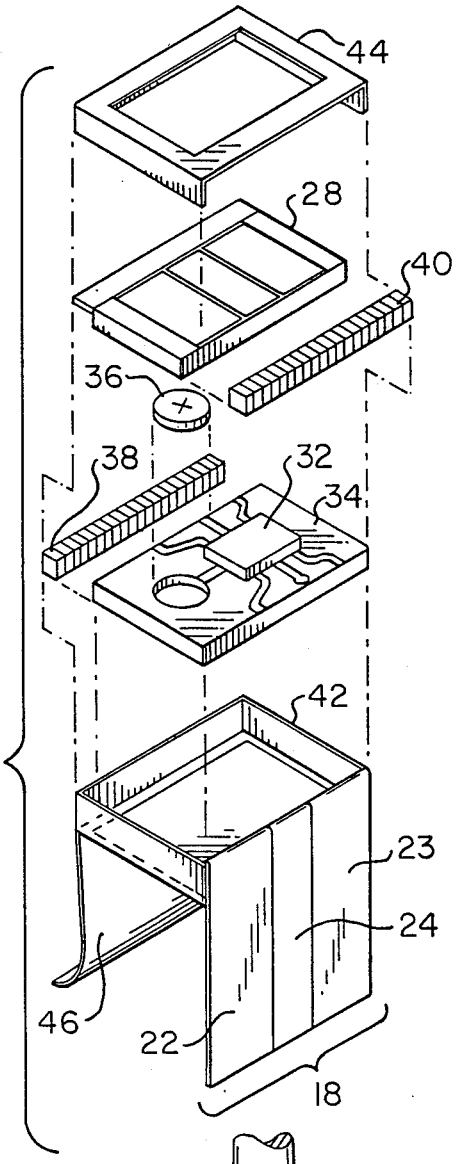
FIG. 2 is an exploded view of the device of FIG. 1.

In preferred embodiments, self contained impact indicating device 14 includes, other elements in addition to transducer array 18. As shown in enlarged detail in the exploded view of FIG. 2, device 14 will include, as a minimum, a monitor/display system 28; an electronic circuit 32, in this embodiment shown for convenience as a circuit board 34, and power source 36. Monitor/display 28 may include liquid crystal display (LCD) elements, or one or more light emitting diode (LED), or other visible light or display elements. As discussed in more detail with regard to FIG. 7, monitor/display system 28 may also be an audible sound generator. Power source 36 may be a battery which can be connected directly to circuit board 34, as shown. Transducer array 18 and the monitor/display 28 may be connected to circuit board 34 using elastomeric conductors 38 and 40, as shown, or using other art known means. The entire self contained impact indicating device 14 is contained within housing 42 and housing cover 44, which can be removably connected together. Housing 42 carries a clip 46 for use in attaching and detaching device 14 to and from club head 16.

FIG. 3, shows golf club 10 with device 14 attached, as described above, striking golf ball 26 with the impact center portion of face 20, as would be desired for a proper golf stroke. The impact center portion of face 20 is covered by middle transducer 24. When middle transducer 24 is so contacted, it generates an electrical signal. Transducers 22 and 23 will also generate an electrical signal when they contact an item such as a golf ball.

Figure 4:
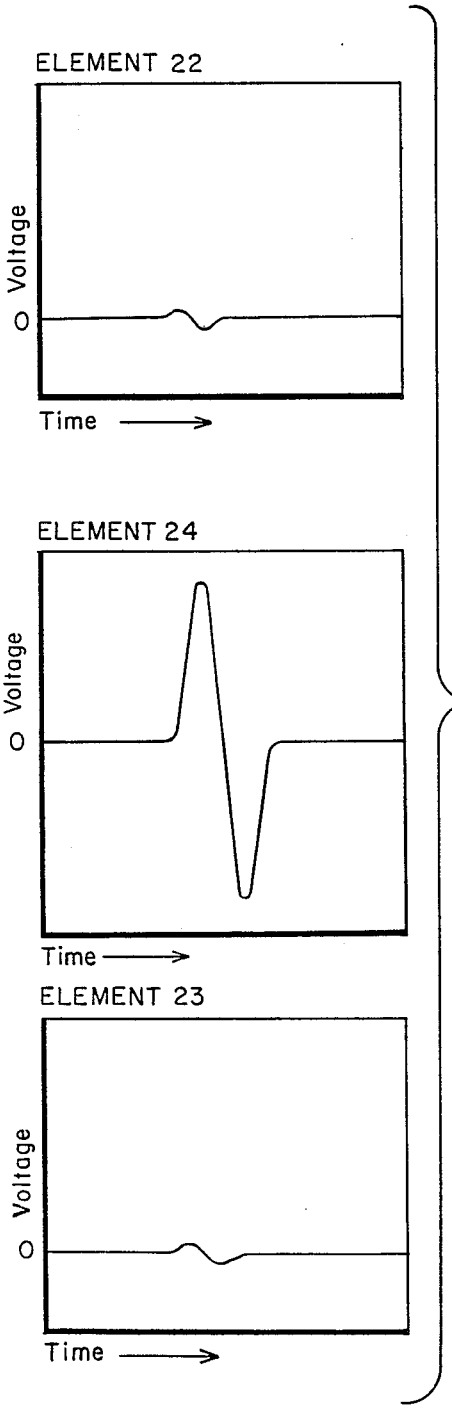
FIG. 4 is a representation of voltages generated by each of the three transducers of FIG. 3.

FIG. 4 is a representation of typical voltages generated on each of the three elements 22, 23, and 24 of transducer array 18, for example, when only middle transducer 24 impacts with golf ball 26, as shown in FIG. 3. Since this is coordinated with the impact displayed in FIG. 3, in which middle transducer 24 impacts with ball 26, elements 22 and 23 are shown to generate virtually no electrical signal, since they have not been directly impacted, while middle transducer element 24 is shown to generate a very high electrical signal, in this case a voltage spike. This is indicative of the fact that golf ball 26 has been struck by middle element 24 of transducer array 18. This will then be made known to the player by means of monitor/display 28, as detailed below in the discussion of FIG. 5.

Figure 5:
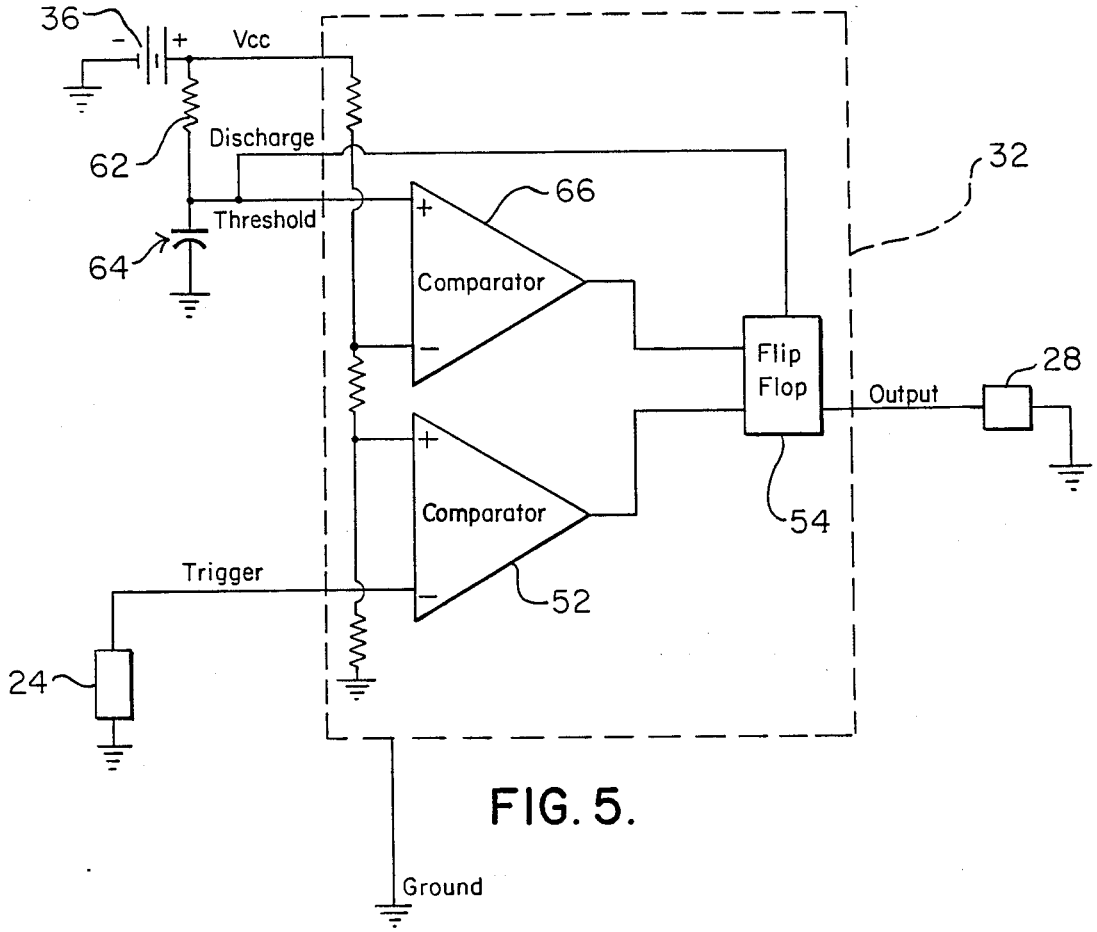
FIG. 5 is a schematic of one circuit for detecting the voltages produced by a transducer during impact, and relay that information to the monitor.

Referring to FIG. 5 there is schematically set forth the details of a circuit of the type that can be used to detect the electric signals, such as voltages, generated by each of the elements 22, 23 and 24 of thin film transducer array 18 during its impact with a ball 26. The electric signals thus generated thereby provide data for determining the point of impact of ball 26 with several thin film transducers which comprise array 18, and effectively the point of impact of ball 26 with face 20. This information is then relayed through electronic circuit 32 to monitor/display 28 so that impact information may be made known to the golfer.

Referring again to FIG. 5, there is shown a diagrammatic representation of one circuit that may be used to detect the voltages on each of the transducer elements of array 18 during impact with ball 26. FIG. 5 shows, external to electronic circuit 32, a source of electrical power 36, such as a battery, and an impact sensitive transducer, for example 24, such as a piezo-electric film that will generate an electric signal when impacted. Within circuit 32 is a trigger element, such as a voltage comparator 52, which senses if the specific element 18 was impacted by a ball, and a flip-flop element 54 which will turn on the monitor/display device 28 which corresponds to that specific transducer when an impact is detected. Once such a trigger signal from transducer 24 is detected by comparator 52 its output is used to set flip-flop 54, which in turn drives monitor/display device 28. The values of the external series resistor 62 and capacitor 64, when connected to a second voltage comparator 66, determine the length of time monitor/display 28 will remain activated before resetting circuit 32 in preparation for the next impact detection. The diagram of FIG. 5 only shows the circuit required for a single transducer 24. In practice it will be substantially duplicated for each transducer element used. Everything shown inside of circuit box 32 in FIG. 5, and in multiple duplicate circuits may be incorporated in a single integrated circuit chip of the type that is commercially available. Therefore the circuit diagram of FIG. 5 is meant to demonstrate only one means of sensing an impact by one transducer located on the face of a golf club by a golf ball, and its use to generate a signal or display. There are many other state-of-the-art circuits that will accomplish the same task.

Figure 6:
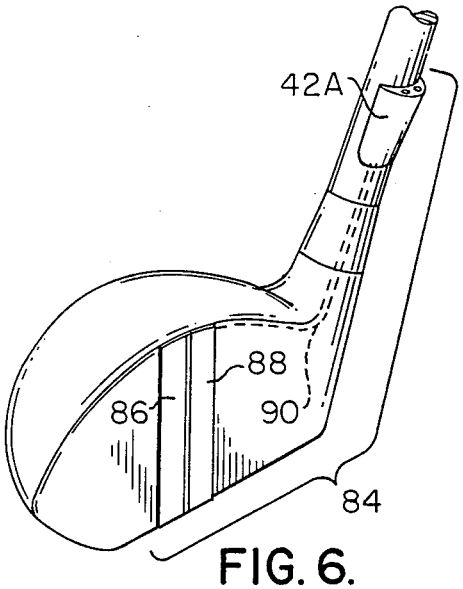
FIG. 6 is a fragmentary isometric view of a modified embodiment of the present invention is integral with a golf club, in this case a wood, and in which a pair of transducer elements are located bracketing the sweet spot of the club face.

FIG. 6 shows another embodiment of the present invention. In this embodiment impact detecting device 84 is located on another type of club, in this case a wood, and is a non-detachable integral part of the club. Also in this embodiment impact detecting device 84 consists of only two transducer elements 86 and 88. Elements 86 and 88 are illustrated as being located on the face of the club in such a manner that they bracket and are substantially adjacent to and equally spaced from the impact center. Housing 42A is illustrated as being located on the shaft of the club rather than on the club head, and as an integral part of that shaft rather than as a detachable member. Housing 42A may carry, for example, a power source, electronic circuits, a pair of externally visible LEDs, and the like. Transducer elements 86 and 88 are electrically connected to housing 42A by means of wire 90 which is shown in phantom imbedded in the body of the club. In the use of the two transducer embodiment of FIG. 6, if the sweet spot on the face of the club strikes the ball, then both associated circuits are activated to thereby cause both LEDs to light, thereby indicating a proper stroke. If the sweet spot on the face of the club misses the ball, then only one circuit is activated to thereby cause only one LED to light, thereby indicating both an error and the direction of the error. In embodiments such as that shown in FIG. 6, in which the transducer elements are integral with the face of the club, an additional range and selection of transducer materials, including for example piezoelectric ceramics, and other more dense or nonfilm materials may be used.

Figure 8:
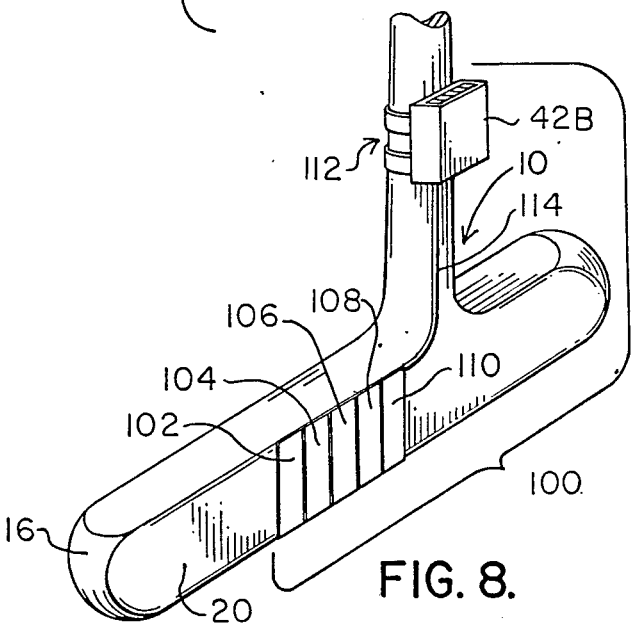
FIG. 8 is a fragmentary isometric view of yet another golf club showing another modified embodiment of the present invention in which five transducer elements are located on the face of a club head, and in which the electronic circuit and power elements are located in a housing which is attachably and detachably clipped to the shaft of the club.
Figure 7:
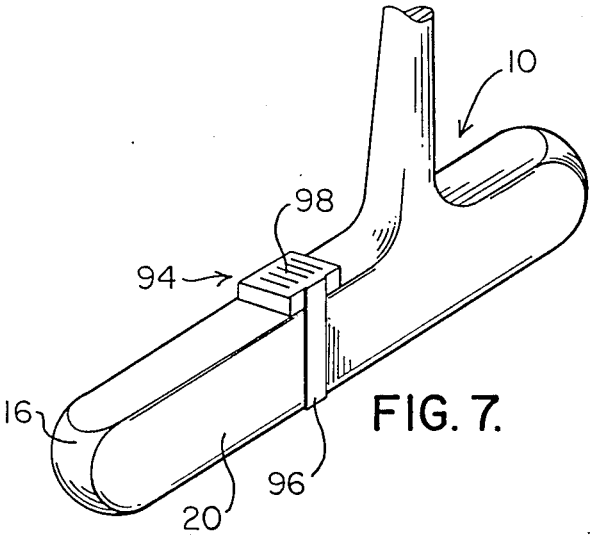
FIG. 7 is a fragmentary isometric view of yet another modified embodiment of the present invention in which a single transducer element is located at the sweet spot of the club face, and in which the monitor emits an audible sound when the element is struck.

Now referring to FIG. 7, there is shown another modified embodiment of the impact detecting system 94 of the present invention. In this embodiment a single transducer element 96 is used, and it is located at the impact center of club face 20. It also illustrates the use of a monitor 98 which emits an audible sound when transducer element 96 strikes a ball. Of course, no sound is made when the impact center misses the ball. Means to create such sound may include, for example, piezoelectric crystals, or other electronic sound producing means. In other embodiments which use more than one transducer, each transducer may be associated with sound of a different pitch, duration or loudness in order to indicate which portion of the club face hit the ball Finally, FIG. 8 provides yet another modified embodiment of the present invention in which five transducer elements 102, 104, 106, 108, and 110 are located on face 20 of club head 16, with transducer element 106 being located over the impact center of the club. The transducer elements are detachably connected to the club face by two sided tape, not shown. Additionally, in which the electronic circuit and power elements are located in this embodiment housing 42B is illustrated as being attachably and detachably clipped to the shaft of the club by means of clip 112. The transducer elements 102, 104, 106, 108, and 110 are electrically connected to housing 42B by means of wire 114.

Many other variations and modifications in the number and location of the transducer elements can be used. For example, horizontal transducers can be used as well as vertical transducers, or a complete matrix of both vertical and horizontal transducers, and associated monitor/display elements can be used to pin point the point of impact, exactly.

The present invention is rendered possible by utilizing a plurality of thin, rugged, impact sensitive transducer elements such as piezoelectric film, film capacitors or force sensitive resistance polymer film. The shape and size of the individual transducer elements can vary greatly depending on many factors including the circuit design, the number of impact points desired, and the size of the sweet spot indicator and adjacent elements. The device of the present invention can be permanently built into the club or separate from the club. If separate, it can be easily attached to or removed from the club and transferred to another club.

While the invention has been particularly shown and described with reference to preferred embodiments thereof, it will be understood by those skilled in the art that the foregoing and other equivalent modifications or changes in form and details may be made therein without departing from the spirit and scope of the invention as defined in and limited solely by the appended claims, except as precluded by the prior art.

What is claimed is:

1. A self contained device for indicating the area of impact of the face of the head of a golf club with a ball, said face of said club having a predetermined impact center, the device comprising:

one or more impact sensitive transducer element which generates an electrical signal in response to an impact;

means responsive to an electrical signal generated by said one or more transducer elements, said responsive means linked to said one or more transducer elements, and;

means to signaling the area of impact of the face of the club with a ball, said signaling means being linked to and responsive to said means responsive to an electrical signal generated by said one or more transducer elements;

a single carrying unit, said impact sensitive transducer elements, said electrical signal responsive means, and said signaling means being carried by said single carrying unit; and means for attachably and detachably locating said carrying unit carrying said one or more impact sensitive transducer elements, said signalling means, and said electrical signal responsive means on a golf club so that said one or more impact sensitive transducer elements, overlies the face of the club in a predetermined relationship to the impact center of the face of the club; whereby, when the face of the head of a golf club impacts with a golf ball, an electrical signal is generated by said one or more impact sensitive transducer element to cause said electric signal responsive means to signal the area of impact of the face of the club with a ball.

2. The device of claim 1, wherein there is a single impact sensitive transducer element, and wherein said single transducer element is positioned to substantially overlie the impact center of the face of the club.

3. The device of claim 1, wherein their are two impact sensitive transducer elements, and wherein said two transducer elements are positioned substantially adjacent to, bracketing and equally spaced from the impact center of the face of the club.

4. The device of claim 1, wherein their are three transducer elements, and wherein said three transducer elements are positioned such that a first transducer element substantially overlies the impact center of the face of the club, and wherein the remaining two transducer elements are substantially adjacent to and bracketing said first transducer element.

5. The device of claim 1 wherein said signaling means is selected from the group consisting of visual display systems and audible display systems.

6. The device of claim 5, wherein said means for signaling the area of impact of the face of the club with a ball is a visual display system selected from the group consisting of light emitting diodes and liquid crystal displays.

7. The device of claim 5, wherein said means for signaling the area of impact of the face of the club with a ball is an audible display system, and wherein the audible display which is indicative of the area of impact of the face of the club is selected from the group consisting of pitch, duration and loudness, and combinations of pitch, duration and loudness.

8. The device of claim 1, wherein said one or more transducer element generates voltage when the face of the head of a golf club impacts with a golf ball, and said means responsive to an electrical signal generated by said one or more transducer element is an electronic circuit for monitoring the voltage generated by said one or more transducer element during impact to determine the point of impact.

9. The device of claim 1, wherein said device includes a self contained source of electric power.

10. The device of claim 9, wherein said self contained source of electric power is a battery.

11. The device of claim 1, wherein said electronic circuit includes means for resetting said signaling means after a predetermined period of time.

12. The device of claim 1, wherein said impact sensitive transducer element is a substantially thin, smooth and planar film.

* * * * *